US009542890B2

(12) United States Patent
Nakayama et al.

(10) Patent No.: US 9,542,890 B2
(45) Date of Patent: Jan. 10, 2017

(54) DISPLAY DEVICE INCLUDING FUNCTION OF REDUCING LUMINANCE GRADIENT

(71) Applicant: Japan Display Inc., Minato-ku (JP)

(72) Inventors: Hiroshi Nakayama, Tokyo (JP); Tetsuo Morita, Tokyo (JP); Hiroyuki Kimura, Tokyo (JP); Makoto Shibusawa, Tokyo (JP)

(73) Assignee: Japan Display Inc., Minato-ku (JP)

( * ) Notice: Subject to any disclaimer, the term of this patent is extended or adjusted under 35 U.S.C. 154(b) by 0 days.

(21) Appl. No.: 14/554,614

(22) Filed: Nov. 26, 2014

(65) Prior Publication Data

US 2015/0145902 A1 May 28, 2015

(30) Foreign Application Priority Data

Nov. 27, 2013 (JP) ..... 2013-244810

(51) Int. Cl.
*G09G 3/30* (2006.01)
*G09G 3/32* (2016.01)

(52) U.S. Cl.
CPC ..... *G09G 3/3266* (2013.01); *G09G 3/3233* (2013.01); *G09G 2300/0819* (2013.01); *G09G 2300/0842* (2013.01); *G09G 2300/0861* (2013.01); *G09G 2310/066* (2013.01); *G09G 2320/0233* (2013.01)

(58) Field of Classification Search
CPC ..... G09G 3/3266; G09G 3/3233
See application file for complete search history.

(56) References Cited

U.S. PATENT DOCUMENTS

| | | | | |
|---|---|---|---|---|
| 6,229,506 | B1 | 5/2001 | Dawson et al. | |
| 2005/0017934 | A1 | 1/2005 | Chung et al. | |
| 2007/0268210 | A1 | 11/2007 | Uchino et al. | |
| 2008/0158110 | A1 * | 7/2008 | Iida | G09G 3/3233 345/76 |
| 2010/0026612 | A1 * | 2/2010 | Yamamoto | G09G 3/3233 345/76 |
| 2010/0039411 | A1 * | 2/2010 | Yatabe | G09G 3/3233 345/204 |
| 2010/0188384 | A1 | 7/2010 | Uchino et al. | |

FOREIGN PATENT DOCUMENTS

| | | | | |
|---|---|---|---|---|
| JP | 2005-31630 | | 2/2005 | |
| JP | 2007-310311 | | 11/2007 | |
| JP | 2011145622 | A * | 7/2011 | G09G 3/3266 |

* cited by examiner

*Primary Examiner* — Kwang-Su Yang
(74) *Attorney, Agent, or Firm* — Oblon, McClelland, Maier & Neustadt, L.L.P.

(57) ABSTRACT

According to one embodiment, a display device includes a plurality of pixel units which each includes a light-emitting element and a pixel circuit, a plurality of first scan lines and second scan lines, a plurality of video signal lines, a controller which controls a scan line drive circuit and a signal line drive circuit, wherein the pixel circuit comprises an output switch, a drive transistor, a capacitance, and a pixel switch, wherein the controller controls a reset operation, a cancellation operation, a correction operation, and a light-emitting operation, and the controller deforms a waveform of a control signal which is supplied from the second scan line in a manner that a time of transitioning the pixel switch from an on-state to an off-state is longer than the time of transitioning by a non-deformed control signal, when writing the video voltage signal in the correction operation.

1 Claim, 9 Drawing Sheets

DISPLAY DEVICE INCLUDING FUNCTION OF REDUCING LUMINANCE GRADIENT

CROSS-REFERENCE TO RELATED APPLICATIONS

This application is based upon and claims the benefit of priority from Japanese Patent Application No. 2013-244810, filed Nov. 27, 2013, the entire contents of which are incorporated herein by reference.

FIELD

Embodiments described herein relate generally to a display device and a method for driving the display device.

BACKGROUND

Recently, the demand for a flat display device represented by a liquid crystal display device has been rapidly increasing thanks to its features such as thinness, light weight and low-power consumption. In particular, an active matrix display device which electrically separates an on-pixel and an off-pixel and provides an each pixel with a pixel switch having a function to retain a video signal to an on-pixel is used for a variety of displays such as a mobile information device.

Regarding such a flat active matrix display device, an organic electroluminescent (EL) display device using a self-luminous element has been receiving attention and is being actively researched and developed. An organic EL display device has a feature that it requires no backlight and it is suitable for reproducing a video because of its rapid response capability and also suitable for the use in cold environments because its luminance does not decrease at low temperatures.

Generally, an organic EL display device comprises a plurality of pixels provided side by side in a plurality of rows and in a plurality of columns. Each pixel is constituted by an organic EL element which is a self-luminous element and a pixel circuit which supplies the organic EL element with a drive current, and performs a display operation by controlling the light-emitting luminance of the organic EL element.

In an organic EL display device, there is characteristic variation of a drive transistor provided with a pixel electrode, which causes variation in display luminance and decreases image quality. Therefore, there is proposed an image circuit which includes a circuit for compensating such luminance variation. On the other hand, in an organic EL display device, luminance gradient in which displayed luminance differs in the right and left on a screen occurs in addition to the above-mentioned variation in display luminance.

DETAILED DESCRIPTION

Figure 1:
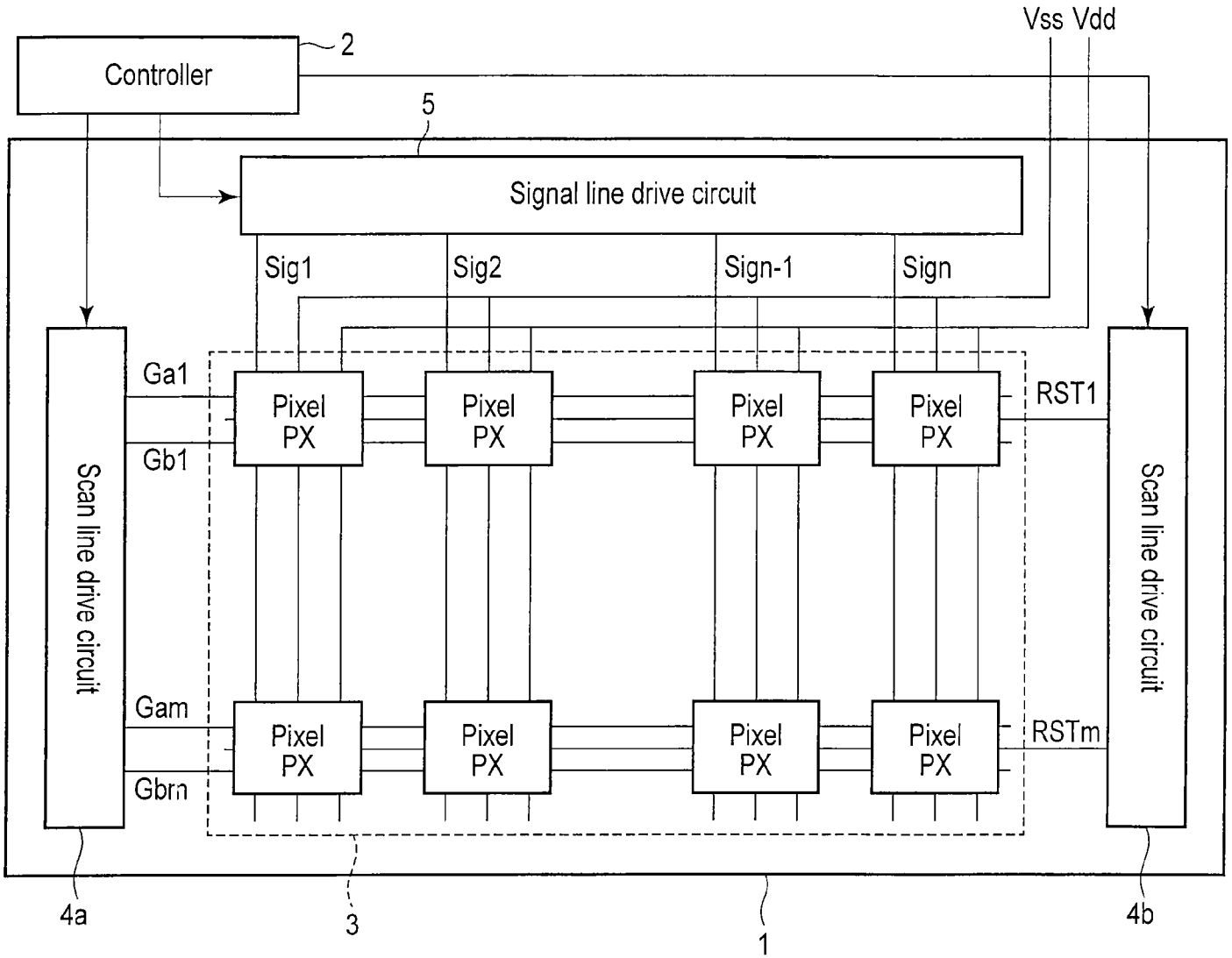
FIG. 1 is a plan diagram schematically illustrating a display device of a first embodiment.

In general, according to one embodiment, a display device includes: a plurality of pixel units which each includes a light-emitting element and a pixel circuit which supplies the light-emitting element with a drive current, the plurality of pixel units being arranged on a substrate in a matrix; a plurality of first scan lines and a plurality of second scan lines each of which is arranged along a row aligned with the pixel unit; a plurality of video signal lines each of which is arranged along a column aligned with the pixel unit;

a plurality of reset power source lines each of which is arranged along the row or the column aligned with the pixel unit; a first power source line and a second power source line; a scan line drive circuit which sequentially supplies a control signal to the plurality of first scan lines and the plurality of second scan lines and line-sequentially scans the pixel unit in a row unit; a signal line drive circuit which supplies the video signal line with a video voltage signal in accordance with the line-sequential scanning; and a controller which controls a drive operation of the scan line drive circuit and the signal line drive circuit, wherein the pixel circuit comprises: an output switch whose first terminal is electrically connected to the reset power source line, whose second terminal is electrically connected to the first power source line, and whose control terminal is electrically connected to the first scan line; a drive transistor whose first terminal is electrically connected to an anode of the light-emitting element and whose second terminal is electrically connected to the reset power source line; a capacitance electrically connected between a control terminal and the first terminal of the drive transistor; and a pixel switch whose first terminal is electrically connected to the control terminal of the drive transistor, whose second terminal is electrically connected to the video signal line, whose control terminal is electrically connected to the second scan line, and the video voltage signal is introduced from the video signal line and is maintained to the capacitance, wherein the controller controls: a reset operation which initializes the drive transistor by applying an initialization potential from the video signal line to the control terminal of the drive transistor and by applying a reset potential from the reset power source line to the first terminal of the drive transistor; a cancellation operation which cancels a threshold voltage of the drive transistor by passing a current from the first power source line to the drive transistor, in a state where the initialization potential is applied from the video signal line to the control terminal of the drive transistor; a correction operation which corrects a mobility of the drive transistor and retains a potential according to the video voltage signal in the capacitance by writing the video voltage signal from the video signal line to the control terminal of the drive transistor through the pixel switch and by passing a current from the first power source line to the drive transistor; and a light-emitting operation which supplies the light-emitting element with a drive current according to the video voltage signal from the first power source line through the drive transistor, and the controller deforms a waveform of a control signal which is supplied from the second scan line in a manner that a time of transitioning the pixel switch from an on-state to an off-state is longer than a time of transitioning the pixel switch from the on-state to the off-state by a non-deformed control signal, when writing the video voltage signal in the correction operation.

Embodiments of the present invention will be described hereinafter with reference to the accompanying drawings.

Incidentally, the disclosure is merely an example, and proper changes within the spirit of the invention, which are easily conceivable by a skilled person, are included in the scope of the invention as a matter of course. In addition, in some cases, in order to make the description clearer, the widths, thicknesses, shapes, etc., of the respective parts are schematically illustrated in the drawings, compared to the actual modes. However, the schematic illustration is merely an example, and adds no restrictions to the interpretation of the invention. Besides, in the specification and drawings, the same elements as those described in connection with preceding drawings are denoted by like reference numerals, and a detailed description thereof is omitted unless otherwise necessary.

First Embodiment

FIG. 1 is a plan diagram schematically illustrating a display device of a first embodiment. As shown in FIG. 1, the display device comprises an organic EL panel 1 and a controller 2 which controls the operation of the organic EL panel 1.

The organic EL panel 1 comprises a display region 3, a scan line drive circuit 4*a*, a scan line drive circuit 4*b* and a signal line drive circuit 5.

The display region 3 comprises m×n display pixels PX which are aligned in a matrix on an insulating substrate having optical transparency such as a glass plate. Each of first scan lines Ga(1-*m*), second scan lines Gb(1-*m*) and reset power source lines RST(1-*m*) is arranged along a row aligned with the display pixel PX and is connected to each display pixel. Also, each of n video signal lines Sig(1-*n*) is arranged along a row aligned with the display pixel PX and is connected to each display pixel in each row. Further, a high-potential power source line Vdd and a low-potential power source line Vss are connected to each display pixel.

The scan line drive circuit 4*a* sequentially drives the first scan line Ga(1-*m*) and the second scan line Gb(1-*m*) in each row of the display pixel PX. The scan line drive circuit 4*b* outputs a reset voltage VRST to the reset power source line RST(1-*m*). The signal line drive circuit 5 drives the plurality of video signal lines Sig(1-*n*). The scan line drive circuits 4*a* and 4*b* and the signal line drive circuit 5 are integrally formed on an insulating substrate outside of the display region 3 and constitute a control unit together with the controller 2.

Note that three display pixels PX for displaying red (R), green (G) and blue (B) are arranged alternately side by side in each row of the display region 3.

Figure 2:
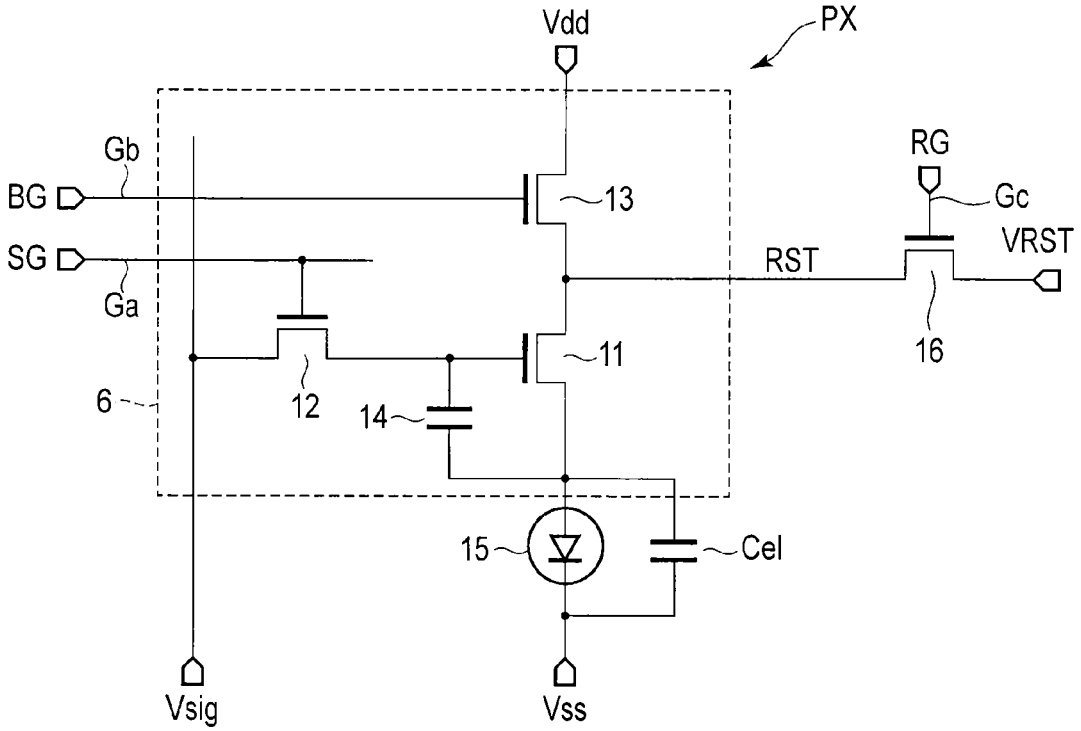
FIG. 2 is a diagram illustrating an equivalent circuit of a display pixel of the display device of the first embodiment.

FIG. 2 is a diagram illustrating an equivalent circuit of a display pixel of the display device of the first embodiment. Each display pixel PX functioning as a pixel unit includes an organic EL element 15 which is a self-luminous element and a pixel circuit 6 which supplies the organic EL element 15 with a drive current.

The pixel circuit 6 of the display pixel PX shown in FIG. 2 is a pixel circuit of a voltage signal mode which controls the light emission of the organic EL element 15 according to a video signal constituting a voltage signal. The pixel circuit 6 comprises a drive transistor 11, a pixel switch 12, an output switch 13 and a retention capacitance 14 as a capacitor. Further, the pixel circuit 6 is connected to the reset power source line RST in which the reset voltage VRST is output from a reset switch 16 provided in the scan line drive circuit 4*b*.

In the display device of the first embodiment, the drive transistor 11, the pixel switch 12 and the output switch 13 are constituted by the same conductive transistor such as an N-channel thin-film transistor (TFT). Also, the drive transistor 11 and a thin-film transistor constituting each switch are thin-film transistors having a top gate structure formed in the same process and in the same structure in which IGZO, a-Si or polysilicon, for example, is used for a semiconductor layer. Note that each switch is not limited to an N-channel type but may be a P-channel type if it functions as a switch.

Each of the drive transistor 11, the pixel switch 12, the output switch 13 and the reset switch 16 comprises a first terminal, a second terminal and a control terminal. In the following description, the first terminal, the second terminal and the control terminal may be referred to as a source, a drain and a gate, respectively.

In the pixel circuit 6 of the display pixel PX, for example, in the display pixel PX for displaying green (G), the drive transistor 11 and the output switch 13 are connected in series to the organic EL element 15 between the high-potential power source line Vdd and the low-potential power source line Vss. The power source line Vdd is set to, for example, a potential of 10V. The power source line Vss is set to, for example, a potential of −4V.

In the output switch 13, its second terminal (drain) is connected to the power source line Vdd, its first terminal (source) is connected to the reset power source line RST and the second terminal (drain) of the drive transistor 11, and its control terminal (gate) is connected to the second scan line Gb. The output switch 13 is thereby on-controlled (conductive state) and off-controlled (non-conductive state) by a control signal BG from the second scan line Gb to control the light-emitting time of the organic EL element 15.

In the drive transistor 11, its first terminal (drain) is connected to the source of the output switch 13 and the reset power source line RST, and its second terminal (source) is connected to one terminal (anode) of the organic EL element 15. The cathode of the organic EL element 15 is connected to the power source line Vss. The drive transistor 11 outputs to the organic EL element 15 a drive current of current amount according to a video signal.

Note that the output switch 13 may be shared by a plurality of pixel circuits 6. In such a case, for example, in the display pixel PX of red (R) and blue (B), the output switch 13 is not provided and the drive transistor 11 is connected between the organic EL element 15 and the reset power source line RST.

In the pixel switch 12, its second terminal (drain) is connected to the video signal line Sig and its first terminal (source) is connected to the gate of the drive transistor 11. The gate of the pixel switch 12 is connected to the first scan line Ga which functions as a gate line for controlling a signal write, and on/off-controlled by a control signal SG supplied from the first scan line Ga. In response to the control signal SG, the pixel switch 12 controls connection and non-connection with the pixel circuit 6 and the video signal line Sig and introduces a video voltage signal from the corresponding video signal line Sig.

The retention capacitance 14, comprising two terminals which face with each other, is connected between the gate and the source of the drive transistor 11 to retain the gate control potential of the drive transistor 11 determined by a video signal.

The reset switch 16 is provided in the scan line drive circuit 4*b* in each row and is connected between the drain of the drive transistor 11 and a power source line which supplies the reset voltage VRST. The gate of the reset switch 16 is connected to a third scan line Gc which functions as a gate line for reset control. The reset switch 16 is on-controlled (conductive state) and off-controlled (non-conductive state) according to a control signal RG from the third scan line Gc and initializes the source potential of the drive transistor 11.

On the other hand, the controller 2 shown in FIG. 1 is formed on a printed circuit board arranged outside the organic EL panel 1 to control the scan line drive circuits 4*a* and 4*b* and the signal line drive circuit 5. The controller 2 receives a digital video signal and a synchronization signal supplied from outside and generates, based on the synchronization signal, a vertical scanning control signal which controls a vertical scanning timing and a horizontal scanning control signal which controls a horizontal scanning timing.

The controller 2 supplies the vertical scanning control signal and the horizontal scanning control signal to the scan line drive circuits 4*a* and 4*b* and the signal line drive circuit 5, respectively. Also, the controller 2 synchronizes with the horizontal and vertical scanning timings to supply the signal line drive circuit 5 with a digital video signal and an initialization signal.

The signal line drive circuit 5 converts into an analogue mode a video signal sequentially obtained in each horizontal scanning period by the control of the horizontal scanning control signal, and supplies in parallel to the plurality of video signal lines Sig(1-*n*) a plurality of gradation voltage signals Vsig which include a red video voltage signal, a green video voltage signal and a blue video voltage signal according to a video signal. Also, the signal line drive circuit 5 supplies the plurality of video signal lines Sig(1-*n*) in parallel with an initialization voltage signal in each horizontal period.

The scan line drive circuit 4*a* which includes a shift register, an output buffer, etc., sequentially transfers to the next stage a vertical scanning start pulse supplied from outside, and supplies two kinds of control signals, i.e., SG(1-*m*) and BG(1-*m*), to the display pixel PX of each row via an output buffer, as shown in FIGS. 1 and 2. The first scan line Ga(1-*m*) and the second scan line Gb(1-*m*) are thereby driven by the control signals SG(1-*m*) and BG(1-*m*), respectively.

The scan line drive circuit 4*b* which includes the reset switch 16, a shift register, an output buffer, etc., controls the reset switch 16 by the control signal RG(1-*m*) which is generated by sequentially transferring to the next stage a vertical scanning start pulse supplied from outside, and supplies the reset voltage VRST to the display pixel PX of each row through the reset power source line RST(1-*m*).

Next, an operation of the display device constituted as above will be described.

Figure 3:
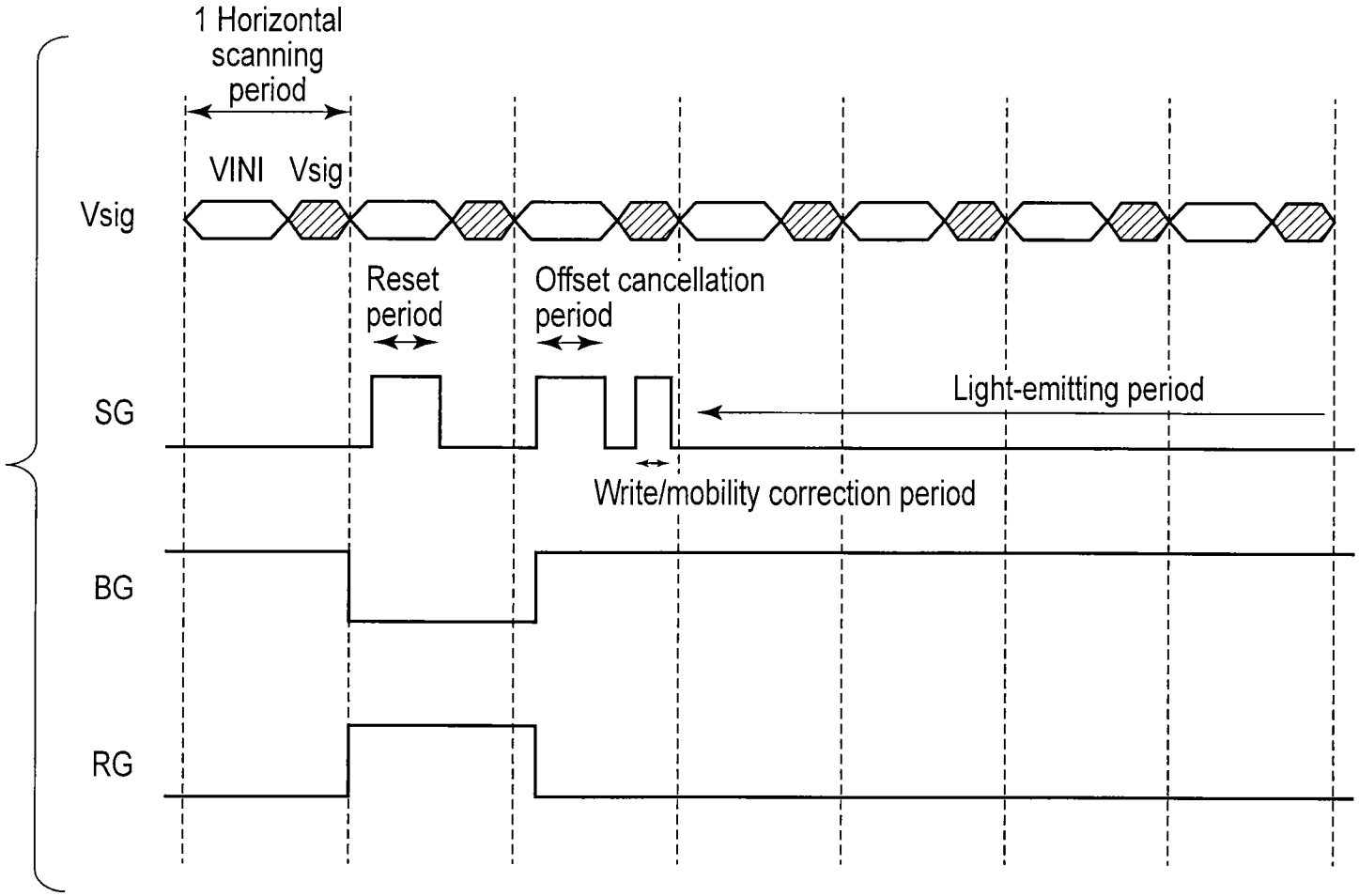
FIG. 3 is a timing chart illustrating a control signal of a scan line drive circuit at a time of a display operation of the display device of the first embodiment.

FIG. 3 is a timing chart illustrating the control signal of the scan line drive circuits 4*a* and 4*b* at the time of the display operation of the display device of the first embodiment.

The operation of the pixel circuit 6 can be divided into a reset operation, an offset cancellation operation, a write/mobility correction operation and a light-emitting operation. Note that an initialization voltage signal VINI is output to the video signal lines Sig(1-*n*) in the first half of a horizontal scanning period and the video voltage signal Vsig is output to the video signal lines Sig(1-*n*) in the second half of the horizontal scanning period.

[Reset Operation]

During the reset period, the control signal BG of a level (low-level) at which the output switch 13 is set to an off-state (off-potential) and the control signal SG of a level (high-level) at which the pixel switch 12 is set to an on-state (on-potential) are output from the scan line drive circuit 4*a*. Inside of the scan line drive circuit 4*b*, the level of the control signal RG reaches a level in which the reset switch 16 is set to an on-state.

This makes the output switch 13 off-state (non-conductive state) and the pixel switch 12 and the reset switch 16 on-state (conducting state), and the initialization voltage signal VINI which is output from each of the video signal lines Sig(1-*n*) is applied to the gate of the drive transistor 11 via the pixel switch 12. The gate potential of the drive transistor 11 is thereby reset to a potential corresponding to the initialization voltage signal VINI and is initialized from the state of the previous frame. The initialization voltage signal VINI is set to, for example, 1V.

During the reset period, the reset voltage VRST is supplied from the reset power source line RST to the drive transistor 11 to start the reset operation. That is, the potential of the source and drain of the drive transistor 11 is reset to a potential corresponding to the reset voltage VRST, for example, to −3V, to initialize the potential state of the previous frame.

[Offset Cancel Operation]

During an offset cancellation period, the control signals SG and BG attain on-potential (high-level) and the control signal RG attains off-potential (low-level). This makes the reset switch 16 off-state (non-conductive state) and the pixel switch 12 and the output switch 13 on-state (conductive state) to start the offset cancellation operation of a threshold of the drive transistor 11.

During the offset cancellation period, the initialization voltage signal VINI which is output from each of the video signal lines Sig(1-*n*) is applied to the gate electrode of the drive transistor 11 via the pixel switch 12 and the gate electrode of the drive transistor 11 is hold to the initialization voltage signal VINI.

Also, since the output switch 13 is in an on-state, a current flows from the power source line Vdd to the drive transistor 11. The source potential of the drive transistor 11 makes the potential VRST written in the reset period an initial value and gradually rises by a current which flows through the drain source of the drive transistor 11 to compensate the variation in a threshold voltage of the drive transistor 11.

The offset cancellation period is set to a time of, for example, several μ seconds. When the offset cancellation period ends, the source potential of the drive transistor 11 reaches VINI−Vth. Note that Vth is the threshold voltage of the drive transistor 11. The voltage between the gate and source of the drive transistor 11 reaches a cancellation point and a potential difference corresponding to this cancellation point is retained in the retention capacitance 14.

[Write/Mobility Correction Operation]

In the write/mobility correction operation, the control signals SG and BG attain on-potential (high-level) and the control signal RG attains off-potential (low-level). This makes the pixel switch 12 and the output switch 13 on-state (conductive state) and the reset switch 16 off-state (non-conductive state). During a write/mobility correction period, the video voltage signal Vsig is written in the gate of the drive transistor 11 from the video signal line Sig through the pixel switch 12.

At this time, since the organic EL element 15 is in a cutoff state, the drain current of the drive transistor 11 flows into a parasitic capacitance Cel of the organic EL element 15. As a result, the source potential of the drive transistor 11 starts to rise and the voltage between the gate and source of the drive transistor 11 reaches Vsig+Vth-ΔV. The write of the signal potential and a correction amount ΔV are thus adjusted.

The higher Vsig is, the larger a current becomes and the larger the absolute value of ΔV becomes. Therefore, it is possible to perform mobility correction according to a light-emitting luminance level. Also, if Vsig is made constant, the larger a mobility μ of the drive transistor 11 is, the larger the absolute value of ΔV becomes. In other words, it is possible to correct variation of each pixel since the larger the mobility μ is, the larger a negative feedback amount ΔV becomes.

[Light-Emitting Operation]

During a light-emitting period, the control signal SG and the control signal RG becomes low-level and the control signal BG becomes high-level, and a drive current flows to the drive transistor 11 of each display pixel of red (R), green (G) and blue (B) from the power source line Vdd via the output switch 13. The drive transistor 11 outputs a drive current of a current amount corresponding to a gate control voltage written in the retention capacitance 14. This drive current is supplied to the organic EL element 15, which then emits light in luminance according to the drive current. The organic EL element 15 maintains a light-emitting state until the control signal BG attains off-potential again after one frame period.

A desired image is displayed by repeatedly performing in each display pixel the above-mentioned reset operation, offset cancellation operation, write/mobility correction operation and light-emitting operation in series.

Next, the cause that luminance gradient occurs on a screen will be described.

At the end of a write/mobility correction operation, when the pixel switch 12 which writes the video voltage signal Vsig from the video signal line Sig is turned off, the gate potential of the drive transistor 11 varies depending on the parasitic capacitance between the gate and source of the pixel switch 12. This voltage variation is called a field-through voltage of the pixel switch 12. When the pixel switch 12 is an N-channel type, the gate potential of the drive transistor 11 shifts to a decreasing direction by a field-through voltage.

The control signal SG is affected by a wiring resistance and a wiring capacitance while transmitting a scan line. Therefore, while a waveform is blunted to a small extent at the supply end of the scan line Ga, a waveform gets blunted to a larger extent as it gets closer to the terminal end of the scan line Ga. Because of the difference of waveform of the control signal SG at the supply end and the terminal end of the control signal SG, the amount of a field-through voltage of the pixel switch 12 varies when the pixel switch 12 is turned off, which gives rise to the difference of gate potential of the drive transistor 11. Since this difference in potential causes a luminance difference, luminance gradient occurs on the left and right of a screen.

Figure 4:
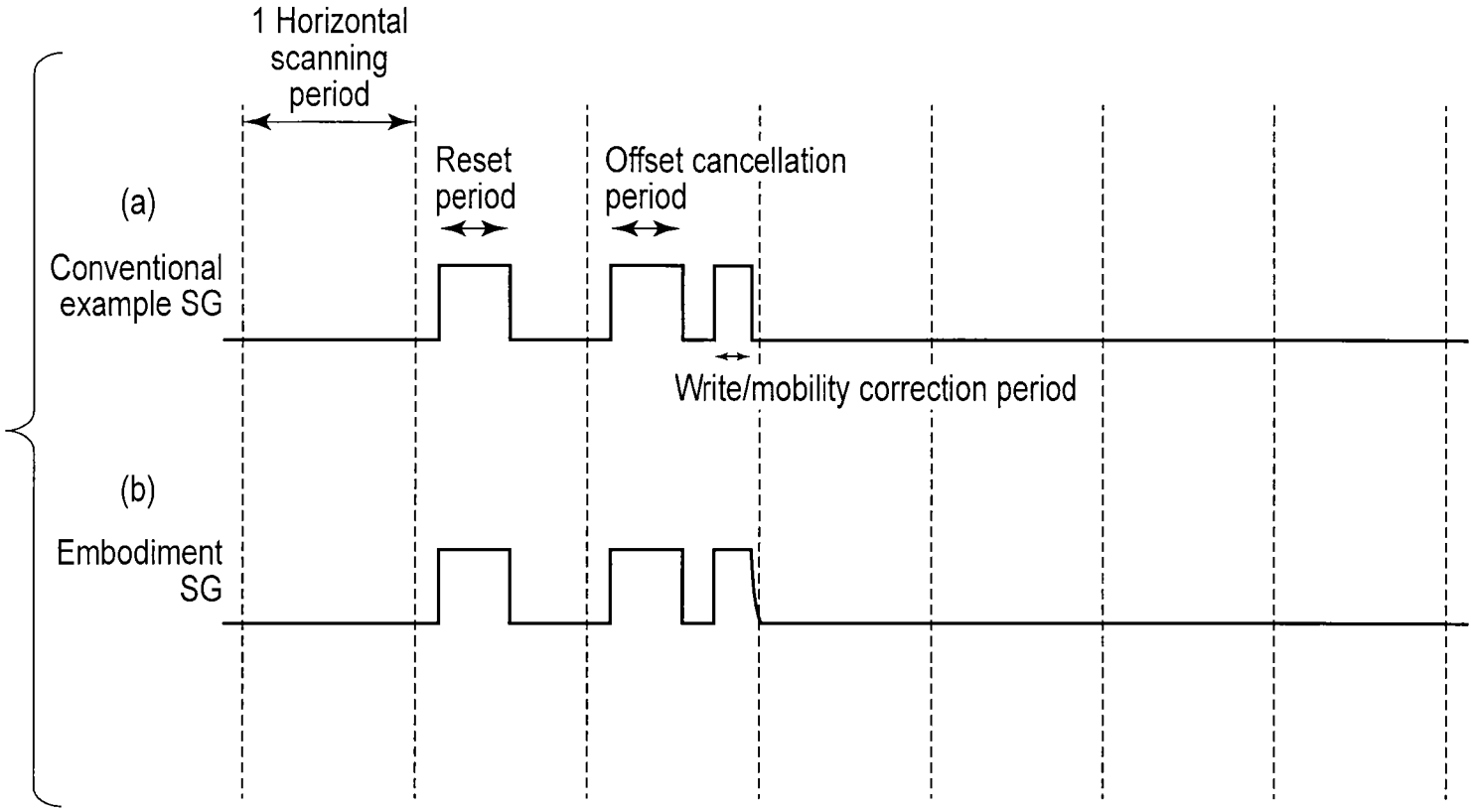
FIG. 4 is a diagram illustrating a method for driving the display device of the first embodiment.

FIG. 4 is a diagram illustrating a method for driving the display device of the first embodiment. FIG. 4(*a*) shows a waveform of the control signal SG at the supply end in a conventional example and FIG. 4(*b*) shows a waveform of the control signal SG at the supply end in the first embodiment.

The control signal SG at the time of the signal write/mobility correction operation is supplied from the scan line drive circuit 4*a* as a waveform whose falling is blunt compared with the convention. By blunting a falling waveform of the control signal SG, it is possible to reduce a field-through voltage when the pixel switch 12 is turned off. Therefore, it is possible to reduce the potential variation of a gate of the drive transistor 11. This makes it possible to reduce the difference in potential variation of the left and right on a screen by a load of the first scan line Ga and to reduce the difference in light-emitting luminance of the left and right on a screen.

Note that falling is not blunted in a waveform of the control signal SG during the reset period and the offset cancellation period. That is, when the control signal SG falls during the reset period and the offset cancellation period, a field-through voltage is not reduced when the pixel switch is turned off. The reset effect and the offset cancellation effect are thereby maintained.

Figure 5:
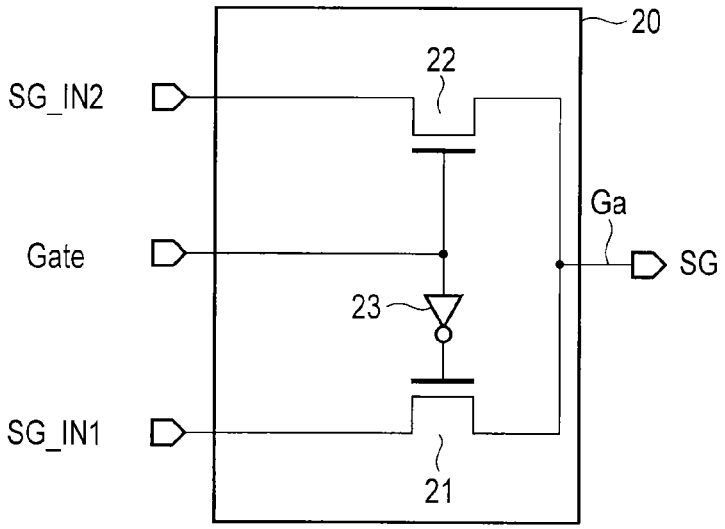
FIG. 5 is a diagram illustrating a control signal conversion circuit for realizing the method for driving the display device of the first embodiment.

FIG. 5 is a diagram illustrating a control signal conversion circuit for realizing the method for driving the display device of the first embodiment.

A control signal conversion circuit 20 is provided in the scan line drive circuit 4*a* and generates the control signal SG to be output to the first scan line Ga. To the control signal conversion circuit 20, a first control signal SG_IN1, a second control signal SG_IN2 and a switch signal Gate are input as an input signal. The first control signal SG_IN1 represents two pulse signals corresponding to the control signals SG of the reset period and the offset cancellation period. The second control signal SG_IN2 represents one pulse signal corresponding to the control signal SG of the write/mobility correction period. The switch signal Gate determines which of the first control signal SG_IN1 or the second control signal SG_IN2 is output as the control signal SG.

The control signal conversion circuit 20 comprises a first conversion transistor 21, a second conversion transistor 22 and an inverter 23. The first conversion transistor 21 and the second conversion transistor 22 are, for example, N-type transistors. The first terminal of the first conversion transistor 21 is connected to the first scan line Ga and the second terminal is connected to the input line which supplies the first control signal SG_IN1. The first terminal of the second conversion transistor 22 is connected to the first scan line Ga and the second terminal is connected to the input line which supplies the second control signal SG_IN2. The input line which supplies the switch signal Gate is connected to the control terminal of the second conversion transistor 22 and is connected to the control terminal of the first conversion transistor 21 via the inverter 23.

Two (first and second) shift registers are provided in the scan line drive circuit 4*a*. The first control signal SG_IN1 is configured to be output from the output buffer of the first shift register and the second control signal SG_IN2 is configured to be output from the output buffer of the second shift register.

Figure 6:
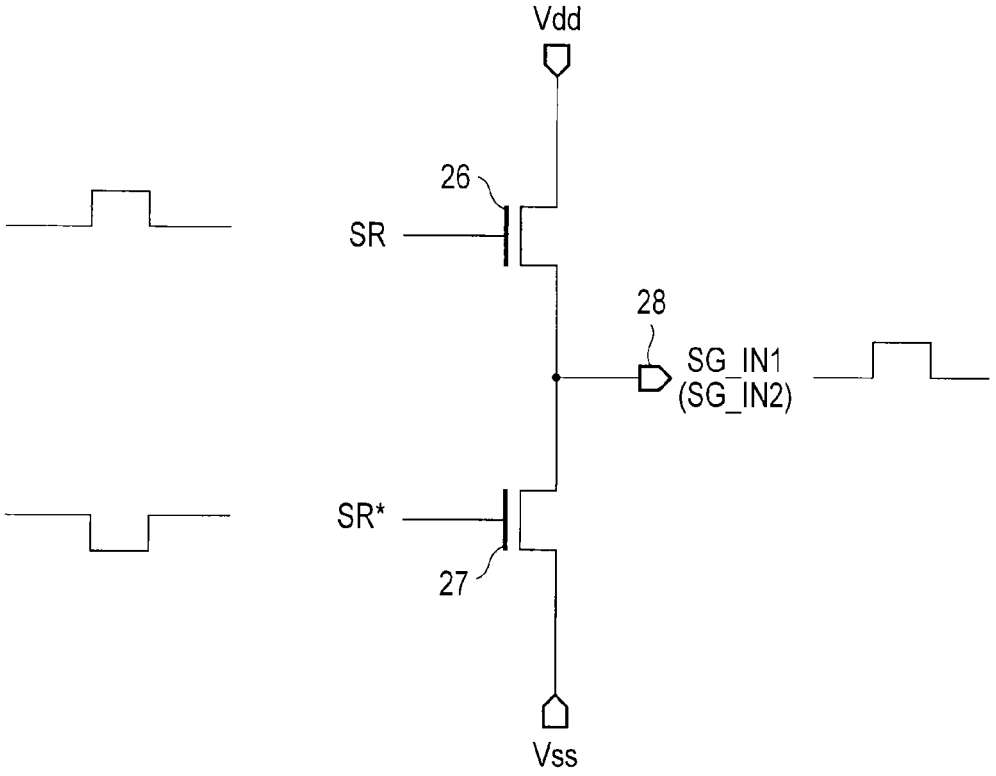
FIG. 6 is a diagram illustrating an output buffer of a shift register of the display device of the first embodiment.

FIG. 6 is a diagram illustrating an output buffer of a shift register of the display device of the first embodiment. While FIG. 6 discloses the output buffer of the first shift register, the same holds true for the output buffer of the second shift register.

An output buffer 25 is constituted by a first buffer transistor 26 and a second buffer transistor 27. The drain of the first buffer transistor 26 is electrically connected to the high-potential power source line Vdd and the source is electrically connected to an output terminal 28, respectively. The drain of the second buffer transistor 27 is electrically connected to the output terminal 28 and the source is electrically connected to the low-potential power source line Vss, respectively.

A shift pulse SR is input to the gate of the first buffer transistor 26 and an inversion signal SR* of the shift pulse SR is input to the gate of the second buffer transistor 27.

Since the inversion signal SR* becomes low-level when the shift pulse SR is high-level, the first buffer transistor 26 turns on (conductive) and the second buffer transistor 27 turns off (non-conductive). Therefore, the potential of the high-potential power source line Vdd appears in the output terminal 28. Since the inversion signal SR* becomes high-level when the shift pulse SR is low-level, the first buffer transistor 26 turns off (non-conductive) and the second buffer transistor 27 turns on (conductive). Therefore, the potential of the low-potential power source line Vss appears in the output terminal 28.

The output from the output terminal 28 is input to the control signal conversion circuit 20 as the first control signal SG_IN1. The second control signal SG_IN2 is similarly input to the control signal conversion circuit 20 via the output buffer of the second shift register.

The W/L of the second buffer transistor 27 which outputs the second control signal SG_IN2 is configured to be smaller than the W/L of the first buffer transistor 26. Further, the W/L of the second buffer transistor 27 which outputs the second control signal SG_IN2 is configured to be smaller than the W/L of the first and second buffer transistor which output the first control signal SG_IN1. Note that W/L is a ratio of channel width (W) and channel length (L), i.e., an aspect ratio.

Figure 7:
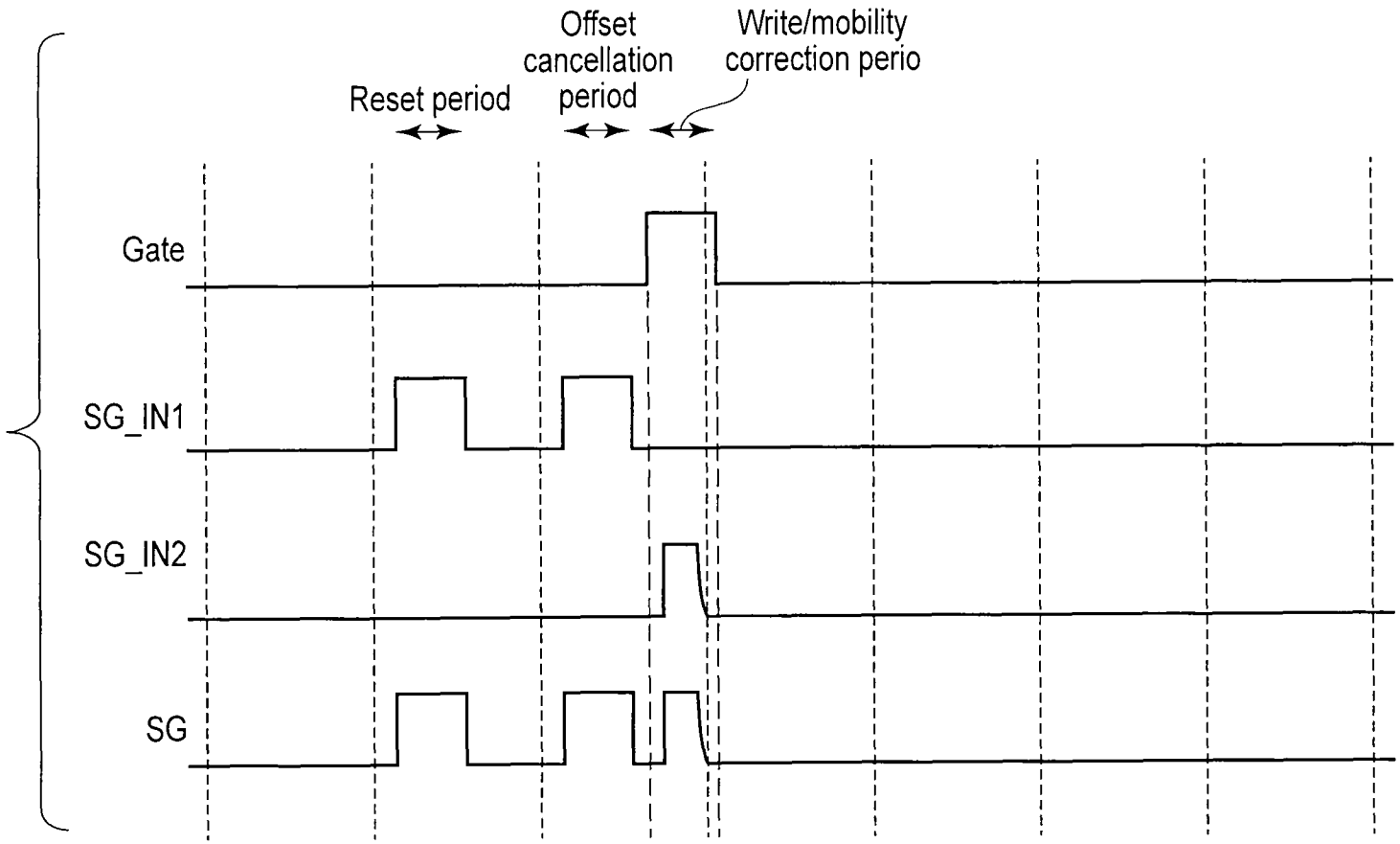
FIG. 7 is a diagram illustrating a control signal conversion sequence for realizing the method for driving the display device of the first embodiment.

FIG. 7 is a diagram illustrating a control signal conversion sequence for realizing the method for driving the display device of the first embodiment.

The switch signal Gate is off during the reset period and the offset cancellation period. Therefore, the first conversion transistor 21 becomes an on-state (conductive) and the second conversion transistor 22 becomes an off-state (non-conductive). As a result, the first control signal SG_IN1 is output to the first scan line Ga as the control signal SG via the first conversion transistor 21.

The switch signal Gate is on during the write/mobility correction period. Therefore, the first conversion transistor 21 becomes off-state (non-conductive) and the second conversion transistor 22 becomes on-state (conductive). As a result, the second control signal SG_IN2 is output to the first scan line Ga as the control signal SG via the second conversion transistor 22.

As mentioned above, the aspect ratio W/L of the second buffer transistor 27 which outputs the second control signal SG_IN2 is configured to be small. Therefore, it is possible to blunt only a falling waveform of the second control signal SG_IN2.

Second Embodiment

In a second embodiment, the shape of the control signal SG at a time of a write/mobility correction operation differs from the shape of the control signal SG of the first embodiment. The portions which produce a similar or the same function as the first embodiment are given the same reference numbers to omit a detailed explanation.

Figure 8:
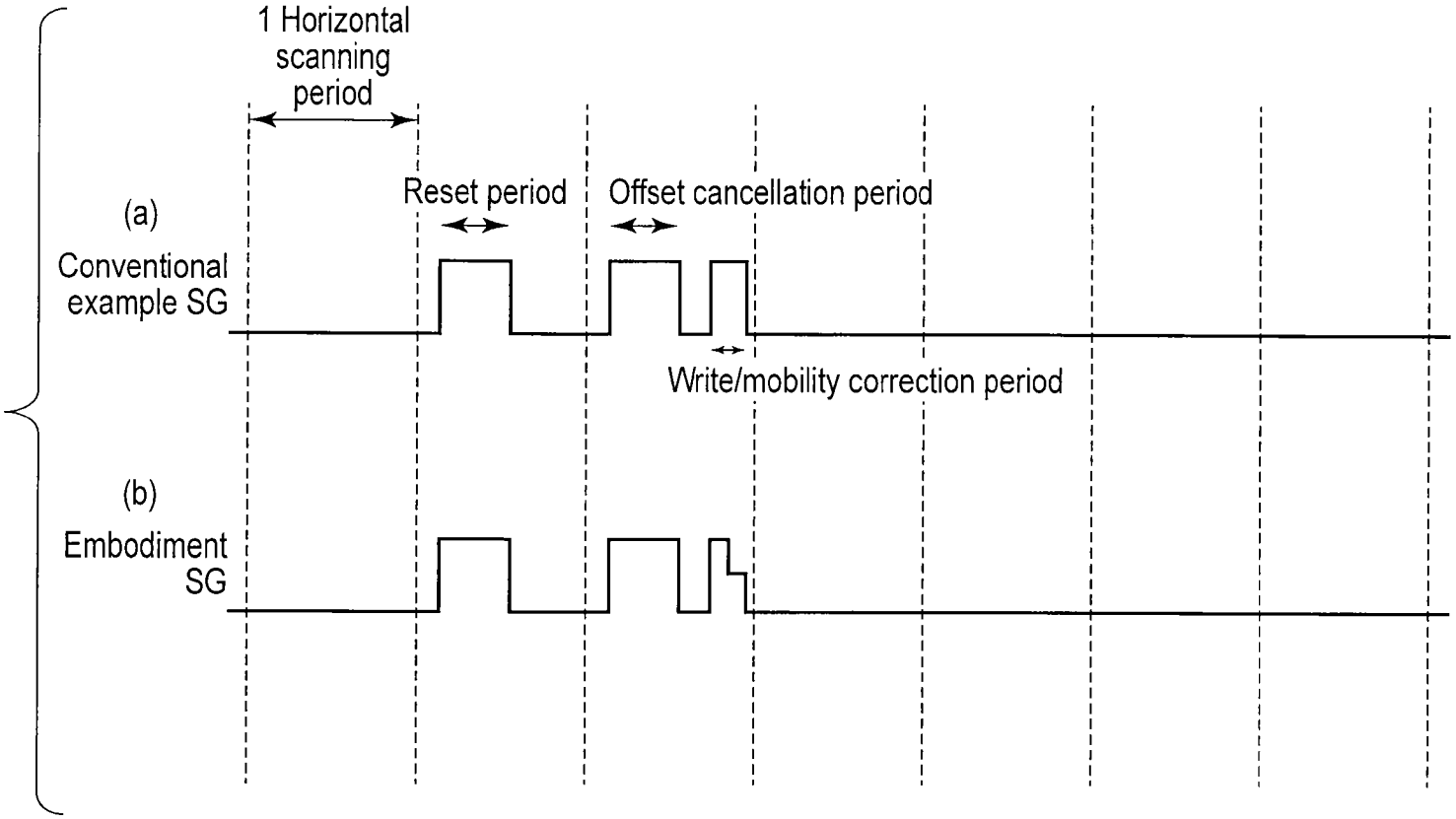
FIG. 8 is a diagram illustrating a method for driving a display device of a second embodiment.

FIG. 8 is a diagram illustrating a method for driving a display device of the second embodiment. FIG. 8(*a*) shows a waveform of the control signal SG at the supply end in a conventional example and FIG. 8(*b*) shows a waveform of the control signal SG at the supply end in the second embodiment.

The control signal SG at the time of a signal write/mobility correction operation supplies the falling waveform from the scan line drive circuit 4*a*, as a waveform whose falling is once reduced to an intermediate voltage between a high potential and a low potential and then reduced to the low potential. By setting a falling waveform of the control signal SG in two stages, it is possible to reduce a field-through voltage when the pixel switch 12 is turned off. Therefore, it is possible to reduce the potential variation of a gate of the drive transistor 11. This makes it possible to reduce the difference in potential variation of the left and right on a screen by a load of the first scan line Ga and to reduce the difference in light-emitting luminance of the left and right on a screen.

Note that a waveform of the control signal SG is not changed during a reset period and an offset cancellation period. That is, when the control signal SG falls during the reset period and the offset cancellation period, a field-through voltage is not reduced when the pixel switch is turned off. The reset effect and the offset cancellation effect are thereby maintained.

Figure 9:
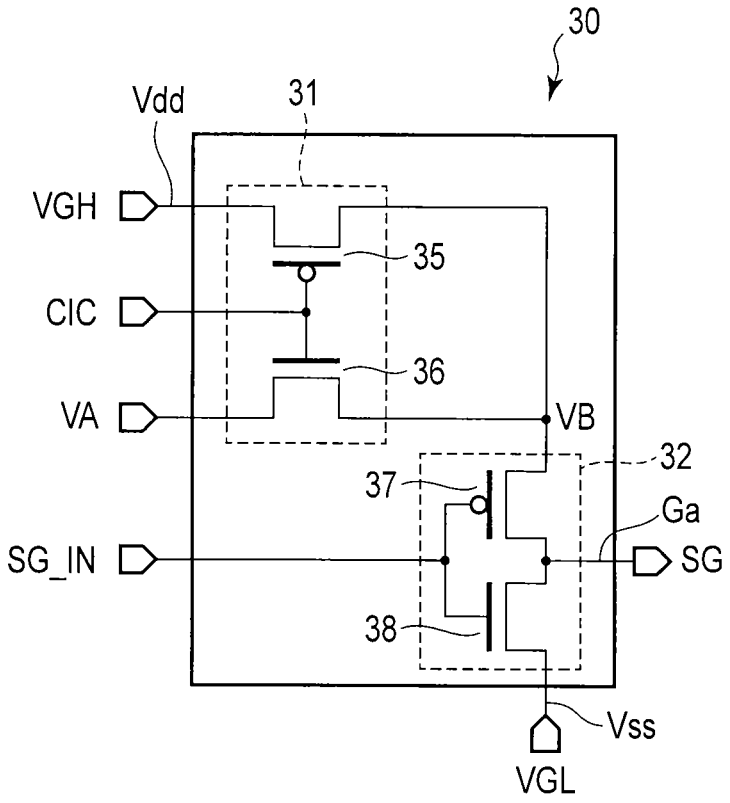
FIG. 9 is a diagram illustrating a control signal conversion circuit for realizing the method for driving the display device of the second embodiment.

FIG. 9 is a diagram illustrating a control signal conversion circuit for realizing the method for driving the display device of the second embodiment.

A control signal conversion circuit 30 is provided in the scan line drive circuit 4*a* and generates the control signal SG to be output to the first scan line Ga. The control signal conversion circuit 30 comprises a level conversion circuit 31 and a signal generation circuit 32. The level conversion circuit 31 converts the potentials of two levels of a high potential and an intermediate potential and outputs them. The signal generation circuit 32 generates the control signal SG of the second embodiment.

To the level conversion circuit 31, a high potential VGH, an intermediate potential VA and a synchronization signal CIC are input as an input signal. The high potential VGH is a voltage supplied from the high-potential power source line Vdd. The intermediate potential VA is a potential between a high potential and a low potential. The synchronization signal CIC designates a timing of setting the control signal SG to an intermediate potential. The output potential of the level conversion circuit 31 is output as a potential of a node VB.

The level conversion circuit 31 comprises a high-potential transistor 35 and an intermediate-potential transistor 36. The high-potential transistor 35 is, for example, a P-type transistor. The intermediate-potential transistor 36 is, for example, an N-type transistor. The second terminal of the high-potential transistor 35 is connected to the high-potential power source line Vdd which supplies the high potential VGH, and the first terminal is connected to the node VB. The second terminal of the intermediate-potential transistor 36 is connected to an input line which supplies the intermediate potential VA, and the first terminal is connected to the node VB. The control terminals of the high-potential transistor 35 and the intermediate-potential transistor 36 are both connected to an input line which supplies the synchronization signal CIC.

To the signal generation circuit 32, a shift register output signal SG_IN, a node VB potential and a low potential VGL are input as an input signal. The shift register output signal SG_IN represents three pulse signals corresponding to the control signals SGs of the reset period, the offset cancellation period and a write/mobility correction period which are output from a shift register. The low potential VGL is an input signal supplied from the low-potential power source line Vss.

The signal generation circuit 32 comprises a first generation transistor 37 and a second generation transistor 38. The first generation transistor 37 is, for example, a P-type transistor. The second generation transistor 38 is, for example, an N-type transistor. The first terminal of the first generation transistor 37 is connected to the node VB, and the second terminal of the first generation transistor 37 is connected to the first scan line Ga and the first terminal of the second generation transistor 38. The first terminal of the second generation transistor 38 is connected to the first scan line Ga and the second terminal of the first generation transistor 37, and the second terminal of the second generation transistor 38 is connected to the low-potential power source line Vss which supplies the low potential VGL. The control terminals of the first generation transistor 37 and the second generation transistor 38 are both connected to an input line which supplies the shift register output signal SG_IN.

Figure 10:
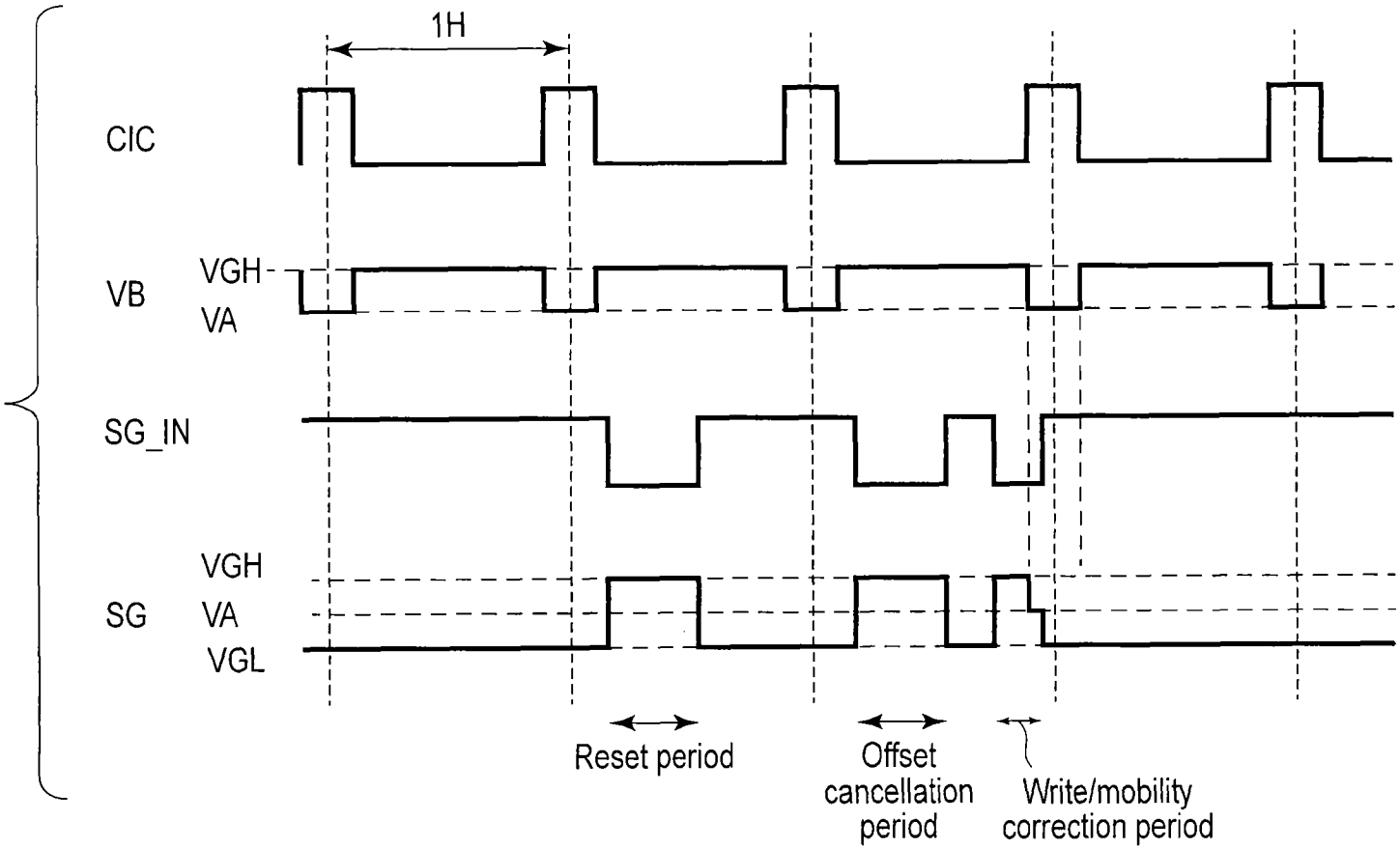
FIG. 10 is a diagram illustrating a control signal conversion sequence for realizing the method for driving the display device of the second embodiment.

FIG. 10 is a diagram illustrating a control signal conversion sequence for realizing the method for driving the display device of the second embodiment.

The synchronization signal CIC is a repetitive pulse signal which reaches a high level before a predetermined time when a horizontal period (1H) ends and which maintains the high-level state by a predetermined time after the next horizontal period starts. While the synchronization signal CIC is high, the intermediate-potential transistor 36 becomes on-state (conductive) and the potential of the node VB becomes the intermediate potential VA. While the synchronization signal CIC is low-level, the high-potential transistor 35 becomes on-state (conductive) and the potential of the node VB becomes the high potential VGH.

The shift register output signal SG_IN is a pulse-column signal which becomes low-level during the reset period, the offset cancellation period and the write/mobility correction period. During the reset period and the offset cancellation period, the first generation transistor 37 becomes on-state (conductive) since the shift register output signal SG_IN is low-level. Therefore, the potential VGH, which is a potential of the node VB, is output as the control signal SG. During the write/mobility correction period, the potential VGH is output as the control signal SG in the first half of the period while the potential of the node VB becomes VA in the second half of the period and therefore the potential VA is output as the control signal SG. Note that while the shift register output signal SG_IN is high, the second generation transistor 38 becomes on-state (conductive) and the low potential VGL, which is a potential of the low-potential power source line Vss, is output as the control signal SG.

Note that the synchronization signal CIC is not limited to the embodiment shown in FIG. 10 but may be a repetitive pulse signal which reaches a high level before a predetermined time when a horizontal period (1H) ends and which reaches a low level when the next horizontal period starts.

While a transistor, a switch, etc., constituting the circuit of a display device are constituted mainly by using an N-type transistor in each embodiment described above, it is also possible to make an N-type transistor a P-type transistor and to make a P-type transistor an N-type transistor. In this case, the pulse waveform shown in the timechart of each embodiment described above is a waveform of reverse polarity.

Also, while the reset power source line RST is arranged along a row aligned with the display pixels PX in each embodiment described above, the reset power source line RST may be arranged along a column aligned by the display pixels PX.

All the display devices and all the methods for driving the display device, which could be embodied by a person with ordinary skill in the art by appropriately changing the designs based on the display devices and the methods for displaying the display device mentioned above as the embodiments of the present invention, pertain to the scope of the present invention as long as the features of the present invention are encompassed.

Since a person with ordinary skill in the art would have conceived the concept of the present invention which is changed or modified to various embodiments, it can be understood that these changed or modified embodiments pertain to the scope of the present invention. For example, the invention, in which a person with ordinary skill in the art appropriately adds, deletes or changes in design the constituting elements for each embodiment described above, or, in which a person with ordinary skill in the art adds, omits or changes in condition the steps for each embodiment described above, pertain to the scope of the present invention as long as the features of the present invention are encompassed.

Also, it can be understood that the effect which is obvious from the description of this embodiment regarding the other effects produced by the aspects described in the present embodiments or the effect which would have been appropriately conceived by a person with ordinary skill in the art is produced by the present invention as a matter of course.

It is possible to form various inventions from an appropriate combination of the plurality of constituting elements disclosed in the above-mentioned embodiments. For example, several constituting elements may be deleted from all the constituting elements shown in the embodiments. Further, the constituting elements of different embodiments may appropriately be combined.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A display device comprising:

a plurality of pixel units which each includes a light-emitting element and a pixel circuit which supplies the light-emitting element with a drive current, the plurality of pixel units being arranged on a substrate in a matrix;

a plurality of first scan lines and a plurality of second scan lines each of which is arranged along a row aligned with the pixel unit;

a plurality of video signal lines each of which is arranged along a column aligned with the pixel unit;

a plurality of reset power source lines each of which is arranged along the row or the column aligned with the pixel unit;

a first power source line and a second power source line;

a scan line drive circuit which sequentially supplies a control signal to the plurality of first scan lines and the plurality of second scan lines and line-sequentially scans the pixel unit in a row unit;

a signal line drive circuit which supplies the video signal line with a video voltage signal in accordance with the line-sequential scanning; and a controller which controls a drive operation of the scan line drive circuit and the signal line drive circuit, wherein the pixel circuit comprises:

an output switch including: a first terminal electrically connected to the reset power source line, a second terminal electrically connected to the first power source line, and a control terminal electrically connected to the first scan line;

a drive transistor including a first terminal electrically connected to an anode of the light-emitting element and a second terminal electrically connected to the reset power source line;

a capacitance electrically connected between a control terminal and the first terminal of the drive transistor; and a pixel switch including: a first terminal electrically connected to the control terminal of the drive transistor, a second terminal electrically connected to the video signal line, a control terminal electrically connected to the second scan line, and the video voltage signal is introduced from the video signal line and is maintained to the capacitance, and wherein the controller controls:

a reset operation which initializes the drive transistor by applying an initialization potential from the video signal line to the control terminal of the drive transistor and by applying a reset potential from the reset power source line to the first terminal of the drive transistor;

a cancellation operation which cancels a threshold voltage of the drive transistor by passing a current from the first power source line to the drive transistor, in a state where the initialization potential is applied from the video signal line to the control terminal of the drive transistor;

a correction operation which corrects a mobility of the drive transistor and retains a potential according to the video voltage signal in the capacitance by writing the video voltage signal from the video signal line to the control terminal of the drive transistor through the pixel switch and by passing a current from the first power source line to the drive transistor; and a light-emitting operation which supplies the light-emitting element with a drive current according to the video voltage signal from the first power source line through the drive transistor, the controller deforms a waveform of a control signal which is supplied from the second scan line in a manner that a time of transitioning the pixel switch from an on-state to an off-state is longer than a time of transitioning the pixel switch from the on-state to the off-state by a non-deformed control signal, when writing the video voltage signal in the correction operation, and a ratio (W/L) of a channel width (W) and a channel length (L) of a second buffer transistor, which outputs a control signal supplied from the second scan line to transition the pixel switch from the on-state to the off-state in the correction operation, is smaller than a ratio (W/L) of a channel width (W) and a channel length (L) of a first buffer transistor, which outputs a control signal supplied from the second scan line to transition the pixel switch from the on-state to the off-state in the reset operation and the cancellation operation.

* * * * *